United States Patent [19]

Habich et al.

[11] 4,245,916

[45] Jan. 20, 1981

[54] DAISY WHEEL PRINT ELEMENT STRUCTURED FOR USE IN A CARTRIDGE

[75] Inventors: Adolph B. Habich; Ronald E. Hunt, both of Austin, Tex.

[73] Assignee: International Business Machines Corporation, Armonk, N.Y.

[21] Appl. No.: 968,322

[22] Filed: Dec. 11, 1978

[51] Int. Cl.[3] ..... B41J 1/30

[52] U.S. Cl. ..... 400/144.2; 400/175

[58] Field of Search ..... 400/144.2, 144.4, 175; 101/93.19

[56] References Cited

U.S. PATENT DOCUMENTS

| | | | |
|---|---|---|---|
| 4,127,335 | 11/1978 | Bogert et al. | 400/175 X |
| 4,209,262 | 6/1980 | Savage | 400/144.2 |

*Primary Examiner*—Paul T. Sewell

*Attorney, Agent, or Firm*—James H. Barksdale, Jr.

[57] ABSTRACT

A daisy wheel printer print element adapted to be housed and oriented in a cartridge during printing and storage. The element has a hammer impact side and a printing side and is made up of a circular central hub, petals connected to the hub and extending radially therefrom, and types carried on the outer extremities of the petals on the printing side of the element. The central hub is dish shaped with its protruding side on the impact side of the element. Carried on the protruding side of the central hub is an orientation protrusion having a stabilizing surface engulfing the axis of rotation of the element. The orientation protrusion is for cooperating with a matching opening in the cartridge. The stabilizing surface is for cooperating with a mating face on a selection motor drive hub. Within the orientation protrusion is a depression also engulfing the axis of rotation of the element. Located within the depression and radially displaced from the axis of rotation of the element is a drive opening. The drive opening is for accepting a drive pin carried by the drive hub. On the printing side of the element and centered within the dished side of the central hub is a bearing protrusion for acting against a bearing surface provided in the cartridge.

11 Claims, 6 Drawing Figures

FIG. 3
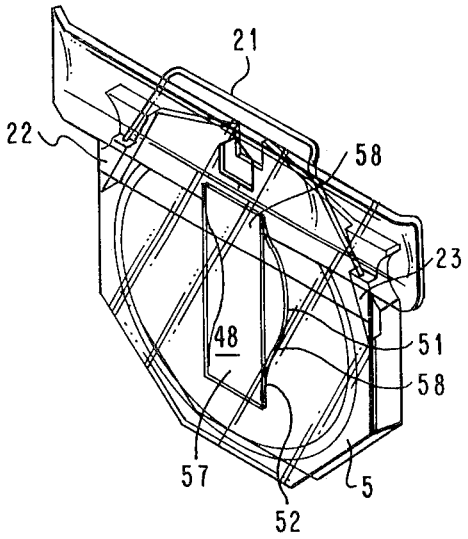
FIG. 4
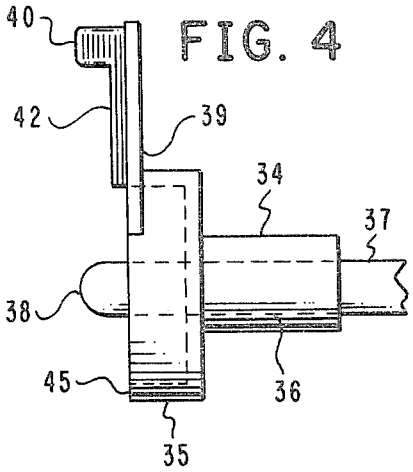
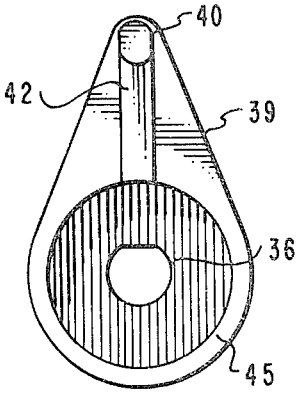
FIG. 5
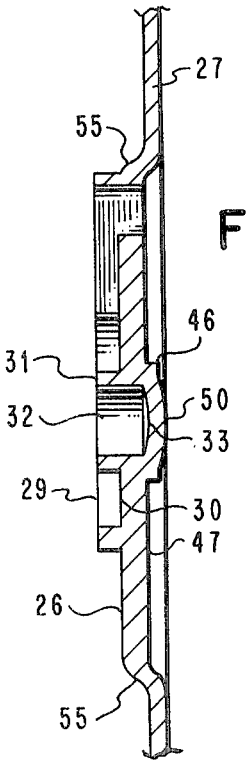
FIG. 6

DAISY WHEEL PRINT ELEMENT STRUCTURED FOR USE IN A CARTRIDGE

DESCRIPTION

CROSS-REFERENCES TO RELATED APPLICATIONS

U.S. Pat. application Ser. No. 968,321 filed Dec. 11, 1978, entitled "Print Element Cartridge", and having A. B. Habich et al. as inventors.

U.S. Pat. application Ser. No. 968,320 filed Dec. 11, 1978, entitled "Print Package", and having A. B. Habich et al. as inventors.

BACKGROUND OF THE INVENTION

1. Field of the Invention

This invention generally relates to daisy wheel printers. More specifically, this invention relates to a daisy wheel print element adapted to be housed and oriented in a cartridge during printing and storage. 2. Description of the Prior Art Representing other work in this same area is U.S. Pat. application Ser. No. 767,250, filed Feb. 10, 1977, now U.S. Pat. 4,127,335 having Bogert et al. as inventors and entitled "Impact Printer With Cartridge Print Wheel". A daisy wheel printer print element is disclosed in this referenced application. There are a number of notable similarities between the print elements in the instant and referenced applications. In both applications there are generally disclosed (1) a print element which is to be housed in a cartridge and received by a printer carrier mechanism with minimum operator intervention, (2) a central hub and radially extending petals, (3) a centered bearing projection on the printing side of the print element central hub, (4) a drive opening radially displaced from the axis of rotation of the print element, and (5) an axially aligned annular extension located on the hammer impact side of the print element.

Several of the more important distinctions between the two applications and the advantages thereof as related to the instant application will now be addressed. To begin with, the central hub of the instant application is dish shaped with the protruding side thereof being on the impact side of the print element. The advantages of this are that (1) the print element, taken as a whole, can be made relatively thin and still resist warp, (2) with the print element being relatively thin, mass associated problems are reduced, (3) when the print element is utilized in a cartridge during both printing and storage, the petals are displaced from an adjacent cartridge surface, and (4) the surface area of the element in contact with the cartridge is at a minimum during storage. Another distinction is that the protruding side of the central hub of the instant application carries an orientation protrusion. The orientation protrusion is for mating with a matching orientation opening in the cartridge to latch the print element in a required rotational position for acceptance by a printer. The orientation protrusion has a stabilizing face surface for mating with a face of a drive hub for imparting dimensional stability to the print element a radial direction perpendicular to the axis of rotation of the element. Within the orientation protrusion which engulfs the axis of rotation of the print element is a depression, part of which is for reducing the mass of the print element and part of which is for mating with a portion of the selection motor drive hub. Extending from the bottom of the depression is a cylindrical extension having an axially aligned opening. The depth of the opening is sufficient to accept a selection motor drive shaft extending through the drive hub and impart additional dimensional stability to the print element. The advantages of the orientation protrusion associated structure are a low mass print element which can be properly oriented and located relative to the cartridge and drive hub, and be dimensionally stabilized by the drive hub.

Other distinctions and advantages of the instant application over the referenced application will be appreciated when reference is made to the accompanying drawing and the following description of the preferred embodiment.

SUMMARY OF THE INVENTION

A daisy wheel printer print element is provided which is adapted to be removably housed in a cartridge. The element and cartridge form a print package which can be stored, shipped, etc., and utilized during printing in an accepting cartridge printer. The print element has a hammer impact side and a printing side and is basically made up of a central hub, radially extending petals connected to the central hub, and types connected to the petals. When the impact side of a petal on the element is impacted by a print hammer, a type located on the printing side is caused to print a character or symbol on a record medium. The central hub is dish shaped and has its protruding side on the impact side of the element. Located on the protruding side of the central hub is an orientation protrusion having a stabilizing face. The orientation protrusion is for mating with a matching opening in the cartridge to maintain the element oriented in a desired rotational direction. The stabilizing face is for mating with a matching face on a selection motor drive hub to impart dimensional stability to the element. Within the orientation protrusion is a depression having an opening which is radially displaced from the axis of rotation of the element. Also within the depression is a hollow cylindrical extension axially aligned with the axis of rotation of the element. The radially displaced opening is for mating with a drive hub drive pin. The opening in the cylindrical extension is for mating with a selection motor drive shaft which extends through the drive hub. The fit between the drive shaft and extension opening is close and the depth of the extension opening is sufficient to impart additional dimensional stability to the element. Centered within the dished side of the central hub is a protrusion which serves both as a cam follower and a bearing. A bowed leaf spring is positioned within the cartridge. During insertion of the print element into the cartridge, the spring acts against the bearing protrusion to cam the orientation protrusion into the matching opening in the cartridge to latch the element in a desired rotational position. During printing, the drive hub is acting against the element with the orientation protrusion disengaged and unlatched from the matching opening for rotation of the element. During rotation of the element, the bearing protrusion is acting against the spring which serves as a bearing surface.

BRIEF DESCRIPTION OF THE DRAWING

FIG. 3 is a rear perspective view of the cartridge portion of the print package shown in FIG. 1.

FIG. 4 is a side view of the drive hub illustrated in FIG. 1.

FIG. 5 is a front face view of the drive hub illustrated in FIG. 1.

FIG. 6 is a vertical diameter cross-sectional view of the print element shown in FIGS. 1 and 2.

DESCRIPTION OF THE PREFERRED EMBODIMENT

Figure 1:
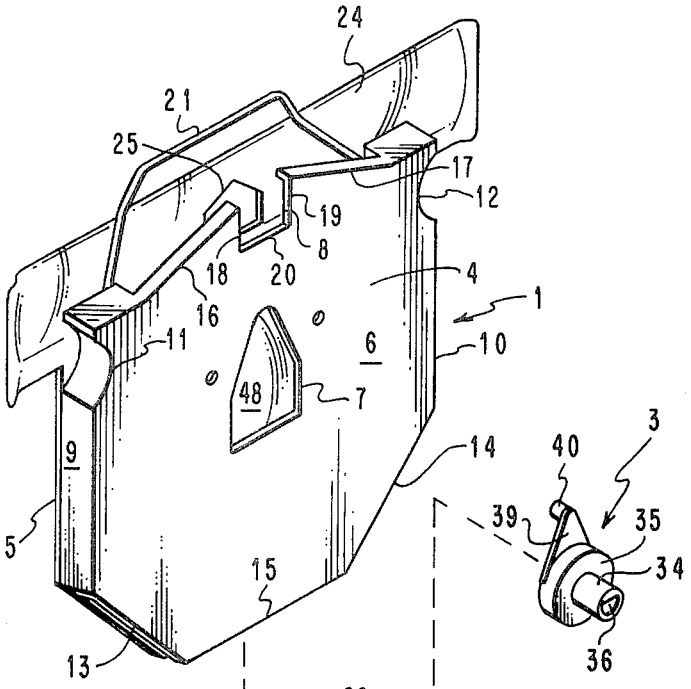
FIG. 1 is a front perspective view of a print package including a cartridge with the print element of this invention removed therefrom. Also illustrated is a selection motor drive hub for causing rotation of the print element.

For a detailed understanding of the invention, reference is first made to FIG. 1. In this figure there is shown a cartridge generally designated by reference numeral 1, a daisy wheel printer print element generally designated by reference numeral 2, and a selection motor drive hub generally designated by reference numeral 3. Print element 2 is the subject of this invention. During actual printing operations, element 2 is housed and rotated within the cartridge 1 by drive hub 3.

Before further discussing print element 2 and its relationship to cartridge 1 and drive hub 3, the following additional background information is deemed in order. In a normal daisy wheel printer arrangement, the mounting of a daisy wheel print element on a selection motor drive hub requires substantial operator interaction in terms of apparatus manipulation. Also, the mounting apparatus is often elaborate. For example, in one common embodiment a knob is secured to the center of the printing side of the print element to provide an operator with a handle. On the opposite side of the print element is an opening for accepting a selection motor drive shaft or hub. The operator procedure is to grasp the print element knob, rotationally orient the print element, and then force the print element onto the drive shaft. Forcing is required since there is a press or interference fit between the print element opening and the drive shaft. Prior to this operation though, the motor must be withdrawn or tilted to provide sufficient room in, or closely adjacent, the print mechanism area for an operator to change or install the print element. Even at this, space is not abundant and the chance of soiled hands is great. After both operations have been completed, the mere handling of the removed print element often results in soiled hands.

The print element of this invention is structured to be removeably housed in a cartridge which aids in substantially minimizing the above noted problems. Ignoring motor withdrawal which is improved in a manner to be described in a later copending application, working space is not a consideration. This is since a print package made up of the print element and cartridge is adapted to be vertically inserted into an accepting printer from a substantially unobstructed location exterior of the limited space print mechanism area. Also, since the print element is substantially totally enclosed in the cartridge, the mere changing of the package for a print element change all but eliminates the possibility of soiled hands.

With the above in mind, the reference is again made to FIG. 1 and specifically to cartridge 1. Cartridge 1 is essentially made up of a shell 4 and a back cover 5. Shell 4 has a front 6 having an orientation opening 7 and a print hammer slot 8. Front 6 faces a print mechanism including a selection motor and a print hammer carried by a printer carrier. Slot 8 is for accommodating the print hammer which is used in a well known manner to facilitate printing. Orientation opening 7 is somewhat arrowhead in shape and generally centralized within front 6. Opening 7 is for cooperating with print element 2 to maintain print element 2 properly oriented during non-use as will be described later herein. Integral with front 4 are side 9 and 10. Sides 9 and 10 have recesses 11 and 12, respectively, which accommodate an operator's thumb and finger for grasping cartridge 1. The lower portion of front 6 has converging tapered edges 13 and 14 which terminate with bottom edge 15. Shell 4 has no side walls along either tapered edges 13 and 14 or bottom edge 15. The outer periphery of back 5 is symmetrical with the periphery of front 6 from recesses 11 and 12 of sides 9 and 10 to bottom 15. Thus, when shell 4 is connected to back 5, cartridge 1 is provided with an open bottom which serves as a loading opening for the insertion and removal of print element 2.

Tapered edges 13 and 14 and the matching portion of back 5 serve two useful purposes. One is that the corners thus eliminated reduce the mass of the cartridge which is carried by a printer carrier during printing operations. The other is that guides are provided for inserting the cartridge into an accepting receptacle on the carrier.

The upper portion of shell 4 has ramps 16 and 17 which extend from adjacent recesses 11 and 12 to near the top center of shell 4 and terminate in slot 8. Slot 8 has sides 18 and 19 and a bottom 20. Slot 8 is large enough to permit clear passage of a print hammer during printing, yet small enough to reduce the chances of an operator having thumb or finger access to print element 2. That is, operator access to print element 2 is restricted by the size of slot 8. Ramps 16 and 17 are to provide enclosure of the upper portion of print element 2 when housed in cartridge 1, and permit as much operator writing line viewing as possible.

Shell 4 carries ribbon guide 21 which can be made up of a metallic wire rod shaped as shown. Referring for a moment to FIG. 3, the interior of shell 4 has integral internal abutments 22 and 23 having openings therein for accepting the ends of ribbon guide 21. Ribbon guide 21 is for guiding a typewriter ribbon in lifted and lowered positions relative to slot 8 during printing.

A cardholder 24 is carried on the upper end of back 5 as an integral portion thereof. Horizontally centered within cardholder 24 is a type opening 25 which is generally aligned with slot 8. The requirements for the dimensions of opening 25 and slot 8 are somewhat different. That is, opening 25 must be (1) located such that it can be properly aligned with a printer platen, and (2) of sufficient width when on-the-fly printing is considered to permit rebound of a print element petal in time to avoid contact with a side of opening 25. While accommodating these requirements, opening 25 is also to be small enough to restrict operator access to print element 2. Also, front 6 and back 5 are spaced sufficiently close together to restrict operator access through either the top or bottom of cartridge 1. Therefore, when print element 2 is housed in cartridge 1, the only area of print element 2 readily contactable by an operator during normal handling of cartridge 1 is that accessible through opening 7.

Figure 2:
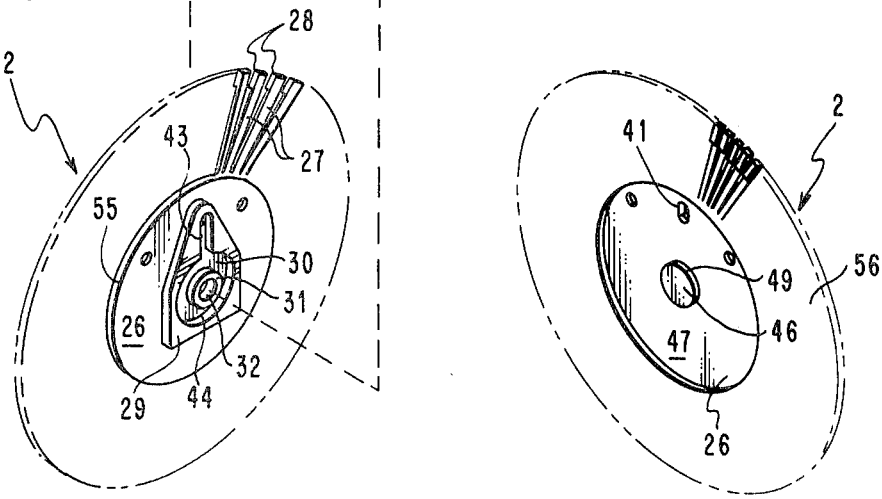
FIG. 2 is a rear perspective view of the print element shown in FIG. 1.

Reference is still to FIG. 1 and now specifically print element 2. As pointed out above, element 2 is to be housed and rotated within cartridge 1 during printing operations. Element 2 is located intermediate the insides of front 6 and back 5 during rotation thereof. Print element 2 is generally daisy wheel in shape and has a central hub 26. Connected to hub 26 are radially extending petals 27. Adjacent the outer extremities of petals 27 are types or character slugs 28 which are utilized in a printing process in a well known manner. Types 28 on petals 27 are located on the printing side of element 2. The opposite side of element 2 is the impact side. On the impact side, petals 27 are structured to be impacted by a print hammer. Referring also to FIGS. 2 and 6, central hub 26 is circular and generally dish shaped in that it has a flanged periphery 55 to which are connected petals 27. Hub 26 carries orientation protrusion 29 on its protruding side as shown. Thus, protrusion 29 is on the impact side of element 2. Protrusion 29 engulfs the axis of rotation of element 2, and has a peripheral arrowhead shape corresponding to opening 7 in cartridge 1. Stated alternatively, opening 7 is a matching opening for protrusion 29. The arrowhead shapes of protrusion 29 and opening 7 are symmetrical with respect to a radius extending vertically and perpendicularly from the axis of rotation of print element 2. For orientation purposes about the axis of rotation of print element 2 though, these shapes are both asymmetrical and insure only one desired orientation of element 2 within cartridge 1.

Within protrusion 29 is a skillet shaped depression 30 also engulfing the axis of rotation of element 2 and having the protruding side of hub 26 as a bottom. Within depression 30 is a cylindrical extension 31 having an opening 32. Opening 32 is axially aligned with the axis of rotation of element 2, and has a bottom 33 below the bottom of depression 30. Opening 32 is for accepting a selection motor drive shaft which extends through hub 3 for centering, and preventing wobble of, element 2 as will be described in greater detail later herein.

Reference is now made specifically to drive hub 3 illustrated in FIGS. 1, 4 and 5. Drive hub 3 is made up of a cylinder 34 connected to a cupped flange 35. Axially centered within cylinder 34 and flange 35 is D-shaped opening 36 extending therethrough. Opening 36 is for accepting a matching selection motor drive shaft 37 having a D-shaped cross-section. D-shaped opening 36 insures a positive rotational connection between shaft 37 and hub 3. Hub 3 is connected along shaft 37 as shown, and may be bonded thereto. If the fit between shaft 37 and opening 32 is sufficiently close, opening 32 is relatively deep, and shaft 37 extends relatively far into opening 32, element 2 is stabilized in a radial direction perpendicular to the axis of rotation of element 2 and shaft 37. That is, any tendency for element 2 to wobble is significantly reduced. Since front 6 and back 5 are to be closely spaced, any wobble of print element 2 on shaft 37 would be particularly undesirable from wear, breakage and free rotation standpoints.

Carried on the periphery of flange 35 is radially extending arm 39. Adjacent the outer end of arm 39 is drive pin 40 structured to communicate with opening 41 (FIG. 2) in element 2. Opening 41 is located in the end of handle 43 of skillet shaped depression 30 and extends through element 2. Pin 40, when inserted into opening 41, is utilized to cause element 2 to rotate upon rotation of shaft 37. Pin 40 and opening 41 have similar peripheries. That is, both have flat side and arcuate ends.

The width of opening 41 is only slightly larger than the width of pin 40. This is to reduce play between element 2 and hub 3 during rotation of element 2 by hub 3. To accommodate varying tolerances though, the length of opening 41 is somewhat greater than the length of pin 40. Therefore, with the overall size of opening 41 being greater than pin 40, the flat sides provide sufficient driving contact areas to reduce wear and indentation problems. Added support for arm 39 is provided by rib 42. Handle 43 is sufficiently wide to freely accept rib 42.

The outer periphery of flange 35 is greater in diameter than the inner periphery 44 of depression 30. As such, face 45 of flange 35 abuts the face of protrusion 29 for radially aligning and stabilizing element 2 to further aid in reducing print element wobble. A flush fit between face 45 and the stabilizing face of protrusion 29 is aided by spring 48 which urges element 2 toward hub 3. The part played by spring 48 will be more fully discussed later in the specification. An important point to note at this time is that hub 3 is not to be displaced from end 38 of shaft 37 sufficiently for end 38 to completely bottom in opening 32 of element 2. Otherwise, a complete mating of face 45 and the face of protrusion 29 may be prevented. Also, even though the outer periphery of flange 35 is greater than the inner periphery 44, flange 35 is still small enough for hub 3 to be freely passed through opening 7 when properly orientated relative to print element 2 when print element 2 is latched in cartridge 1.

The reason for the pan portion of skillet shaped depression 30 is to reduce the mass of element 2. In like manner, flange 35 is cup shaped to reduce mass. Any reduction in mass results in improved response time in starting and stopping rotation of element 2.

Refer next to FIGS. 2 and 6. In these figures is shown the back or printing side 56 of print element 2. Carried on back 56 is a protruding bearing stud 46 centered within the dished side 47 of central hub 26. Stud 46 extends beyond the dish and is adapted to communicate with spring 48 located in cartridge 1 shown in FIG. 1. Stud 46 is made up of a cylinder 49 carrying a bullet extension 50 having an arcuate cross-section. Bullet 50 acts as a bearing for element 2 against spring 48 during rotation of element 2. Spring 48 in turn acts as a bearing surface for bullet 50. When element 2 is housed in cartridge 1 and not being utilized in a printing process, spring 48 provides a thrust against bullet 50 to bias and maintain element 2 latched in cartridge 1.

Before further discussing the relationship of element 2 and spring 48, several specific details of spring 48 and cartridge 1 will be brought out. Referring to FIG. 3, spring 48 is a leaf spring having a bowed center portion 51 extending toward and located adjacent opening 7. In fact, front 6 and back 5 are spaced, and spring 48 is bowed, such that portion 51 acts against the inside of front 6. Back 5 has an inside rectangular depression 52 for accepting and aiding in retaining spring 48 in a desired position relative to opening 7. That is, spring 48 is to be held in place and remain properly oriented both when bowed as shown and when somewhat extended during the time element 2 is located within cartridge 1 and between spring 48 and front 6. Ends 57 and 58 are located in depression 52 and act against the inside of back 5. Depression 52 is sufficiently long to accommodate spring 48 when extended. Spring 48 is sufficiently long to provide a gradual ramp. Ends 57 and 58 are maintained in depression 52 by front 6 acting against bow 51. Thus, the orientation and length of spring 48, and the extent of bow 51 are such that spring 48 serves as a ramp for bullet 50 of element 2 for camming protrusion 29 toward opening 7 during insertion of element 2 into cartridge 1.

When element 2 is inserted into cartridge 1 from the bottom of cartridge 1, the force of spring 48 must be overcome. As alluded to above, this is because of the proximity of the insides of back 5 and front 6 and the bowed portion 51 acting against the inside of front 6 adjacent opening 7. During insertion of element 2 into cartridge 1, bullet 50 will ride up bow 51. With end 57 seated in depression 52, there will be no snagging of bullet 50 on end 57. When protrusion 29 and opening 7 are aligned, spring 48 will urge and cam protrusion 29 into opening 7 for engagement therewith. Upon engagement of protrusion 29 and opening 7, element 2 is latched in a properly oriented or desired rotational position within cartridge 1. At this time, the print package made up of element 2 and cartridge 1 is available for either printing use or non-use. For printing use, the print package is inserted into an accepting printer. For printing non-use, the print package can be stored, shipped, etc.

Referring again to the relationship of spring 48 and element 2, the width of spring 48 is of great importance when a print element is to be inserted into an empty cartridge. The horizontal width of spring 48 must be sufficient to eliminate the possibility of a print element petal 27 extending through opening 7 during insertion of element 2 into cartridge 1. If spring 48 is made relatively narrow compared to opening 7, a few petals will be forced out of the plane of the remaining petals. To eliminate this possibility, spring 48 in the illustrated embodiment is made wider than opening 7. This results in all petals adjacent opening 7 remaining in the same plane. The vertical orientation of spring 48 is also important relative to petals 27. That is, since petals 27 are radially extending, there will be no snagging on spring 48 if vertically oriented.

When print element 2 is to be used for printing, cartridge 1 having element 2 latched therein is inserted into an accepting hopper in a daisy wheel printer. Thereafter, drive hub 3 and attached selection motor and shaft are translated toward central hub 26. Shaft 37 will mate with opening 32, pin 40 will mate with opening 41, and face 45 will contact the face of protuberance 29. Further translation of hub 3 in the same direction will result in bullet 50 of element 2 causing ends 57 and 58 of spring 48 to extend in the vertical direction. Ultimately, protrusion 29 will clear opening 7 and element 2 will be unlatched for rotation within cartridge 1. During rotation of element 2 for selection and printing, arm 39 and pin 40 will be located within cartridge 1 and spring 48 will act as a bearing surface for bullet 50.

Referring again to print element 2 in FIGS. 1, 2, and 6, the dish shaped central hub 26 has a number of advantages. One is that due to the structural arrangement disclosed, print element 2 taken as a whole can be made relatively thin and still resist warp. In fact, the thickness of central hub 26, excluding protuberance 29 and stud 46, can be essentially the same as the overall thickness of element 2. Another is that protuberance 29 is brought closer to orientation opening 7. This reduces the chances of interference between the remainder of print element 2 and cartridge 1. Further, due to the relationship of the bow in leaf spring 48 to stud 46, the remainder of print element 2 is spaced from the greater part of the spring 48 during rotation of element 2.

For removal of print element 2 from cartridge 1, the operator procedure is to contact protrusion 29 with a thumb and then press in and down. This action results in an unlatching of print element 2 and a downward displacement thereof. If the lower outer periphery of element 2 is relatively close to bottom 15 when element 2 is latched in cartridge 1, very little downward displacement of element 2 is required to supply a sufficient area of element 2 for an operator to grasp. To avoid soiled hands, the operator can simply use a tissue when grasping element 2.

In summary a daisy wheel printer print element is provided which is adapted to be removably housed in a cartridge. The element and cartridge form a print package which can be stored, shipped, etc., and utilized during printing in an accepting cartridge printer. The print element has a hammer impact side and a printing side and is basically made up of a central hub, radially extending petals connected to the central hub, and types connected to the petals. When the impact side of a petal on the element is impacted by a print hammer, a type located on the printing side is caused to print a character or symbol on a record medium. The central hub is dish shaped and has its protruding side on the impact side of the element. Located on the protruding side of the central hub is an orientation protrusion having a stabilizing face. The orientation protrusion is for mating with a matching opening in the cartridge to maintain the element oriented in a desired rotational direction. The stabilizing face is for mating with a matching face on a selection motor drive hub to impart dimensional stability to the element. Within the orientation protrusion is a depression having an opening which is radially displaced from the axis of rotation of the element. Also within the depression is a hollow cylindrical extension axially aligned with the axis of rotation of the element. The radially displaced opening is for mating with a drive hub drive pin. The opening in the cylindrical extension is for mating with a selection motor drive shaft which extends through the drive hub. The fit between the drive shaft and extension opening is close and the depth of the extension opening is sufficient to impart additional dimensional stability to the element. Centered within the dished side of the central hub is a protrusion which serves both as a cam follower and a bearing. A bowed leaf spring is positioned within the cartridge. During insertion of the print element into the cartridge, the spring acts against the bearing protrusion to cam the orientation protrusion into the matching opening in the cartridge to latch the element in a desired rotational position. During printing, the drive hub is acting against the element with the orientation protrusion disengaged and unlatched from the matching opening for rotation of the element. During rotation of the element, the bearing protrusion is acting against the spring which serves as a bearing surface.

While the invention has been particularly shown and described with reference to a particular embodiment, it will be understood by those skilled in the art that various changes in form and detail may be made without departing from the spirit and scope of the invention.

What is claimed is:

1. In a daisy wheel printer print element rotatable for printing and having an impact side, a printing side, and a number of radially extending petals carrying a type on said printing side, wherein the improvement comprises:

(a) a dish shaped central hub having (1) a dished side and a protruding side, (2) said petals connected to the outer periphery of said central hub, and (3) said protruding side on said impact side; and (b) an orientation protrusion engulfing the axis of rotation of said element and carried on said protruding side of said central hub for insuring only one rotational orientation of said print element during printing non-use when said print element is housed in a cartridge having an orientation opening matching said orientation protrusion and said orientation protrusion is in engagement with said orientation opening.

2. A print element according to claim 1 wherein said orientation protrusion includes a stabilizing face.

3. A print element according to claim 2 wherein said orientation protrusion includes a depression having a radially offset drive opening.

4. A print element according to claim 3 including a hollow cylindrical extension located in said depression and axially aligned with the axis of rotation of said element.

5. A print element according to claim 1 including a bearing protrusion located on said dished side of said central hub.

6. A print element according to claim 3 wherein said depression engulfs the axis of rotation of said element.

7. A print element according to claim 1 wherein said orientation protrusion is asymmetrical in shape for orientation purposes about the axis of rotation of said element.

8. A print element according to claim 3 wherein said depression is asymmetrical in shape with respect to the axis of rotation of said element.

9. A print element according to claim 4 wherein the hollow in said cylindrical extension extends below said depression.

10. An element according to claim 9 wherein the thickness of said central hub without said orientation protrusion is substantially the same as that of the overall print element.

11. An element according to claim 10 wherein said bearing protrusion extends exterior of said dished side of central hub.

* * * * *